US008956119B2

(12) United States Patent
Chanteloup

(10) Patent No.: US 8,956,119 B2
(45) Date of Patent: Feb. 17, 2015

(54) TURBINE WHEEL PROVIDED WITH AN AXIAL RETENTION DEVICE THAT LOCKS BLADES IN RELATION TO A DISK

(75) Inventor: Denis Chanteloup, Gelos (FR)

(73) Assignee: Turbomeca, Bordes (FR)

( * ) Notice: Subject to any disclaimer, the term of this patent is extended or adjusted under 35 U.S.C. 154(b) by 827 days.

(21) Appl. No.: 13/139,109

(22) PCT Filed: Dec. 10, 2009

(86) PCT No.: PCT/FR2009/052469

§ 371 (c)(1),
(2), (4) Date: Sep. 9, 2011

(87) PCT Pub. No.: WO2010/067024

PCT Pub. Date: Jun. 17, 2010

(65) Prior Publication Data

US 2011/0311366 A1 Dec. 22, 2011

(30) Foreign Application Priority Data

Dec. 11, 2008 (FR) ..... 08 58461

(51) Int. Cl.
*F01D 5/32* (2006.01)

(52) U.S. Cl.
CPC ..... *F01D 5/326* (2013.01)
USPC ..... 416/193 A; 416/204 R; 416/220 R

(58) Field of Classification Search
CPC ..... F01D 5/326
USPC ..... 416/193 A, 220 R, 204 R
See application file for complete search history.

(56) References Cited

U.S. PATENT DOCUMENTS 2,755,063 A * 7/1956 Wilkinson ..... 416/221
3,047,268 A * 7/1962 Leavitt ..... 416/220 R
3,888,601 A 6/1975 Classburn
4,221,542 A 9/1980 Acres et al.
4,730,983 A * 3/1988 Naudet et al. ..... 416/220 R
5,052,893 A * 10/1991 Catte ..... 416/220 R
5,256,035 A 10/1993 Norris et al.
5,302,086 A 4/1994 Kulesa et al.
5,320,492 A * 6/1994 Bouru et al. ..... 416/220 R

FOREIGN PATENT DOCUMENTS

FR 2 345 605 10/1977
GB 2 011 551 7/1979

OTHER PUBLICATIONS

U.S. Appl. No. 13/140,078, filed Jun. 16, 2011, Arilla, et al.
International Search Report Issued Jun. 21, 2010 in PCT/FR09/052469 filed Dec. 10, 2009.

* cited by examiner

*Primary Examiner* — Ninh H Nguyen
(74) *Attorney, Agent, or Firm* — Oblon, Spivak, McClelland, Maier & Neustadt, L.L.P.

(57) ABSTRACT

A turbine wheel including a plurality of blades, each of the blades presenting an airfoil, a platform, and an attachment member, a disk having the blades mounted at the periphery thereof, the attachment member of each blade being engaged in a housing that opens into a periphery of the disk and extending axially between two opposite faces of the disk, the housings being separated by teeth, and an axial retention device for retaining the blades. The disk includes a first stop member, and the platform of the blade includes a projection projecting axially beyond one of the faces of the disk. The projection includes a second stop member. The axial projection, the second stop member, and the face of the disk together form a groove facing towards the axis of the disk, the groove serving to receive the axial retention device.

13 Claims, 4 Drawing Sheets

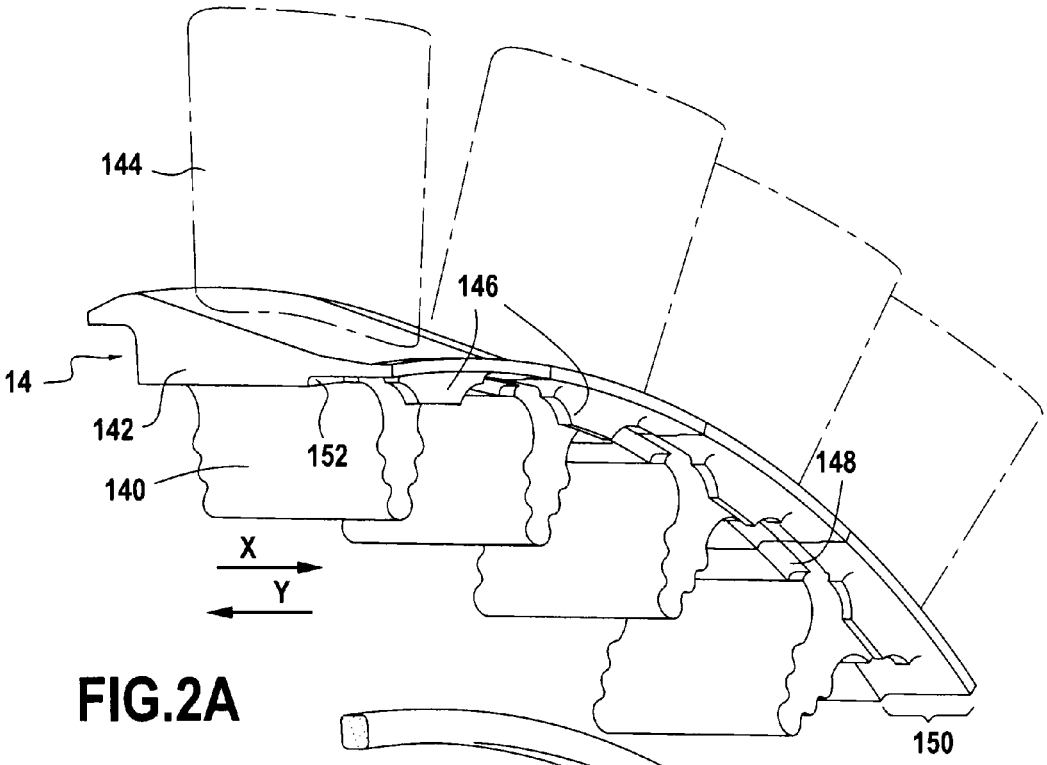
FIG.2A
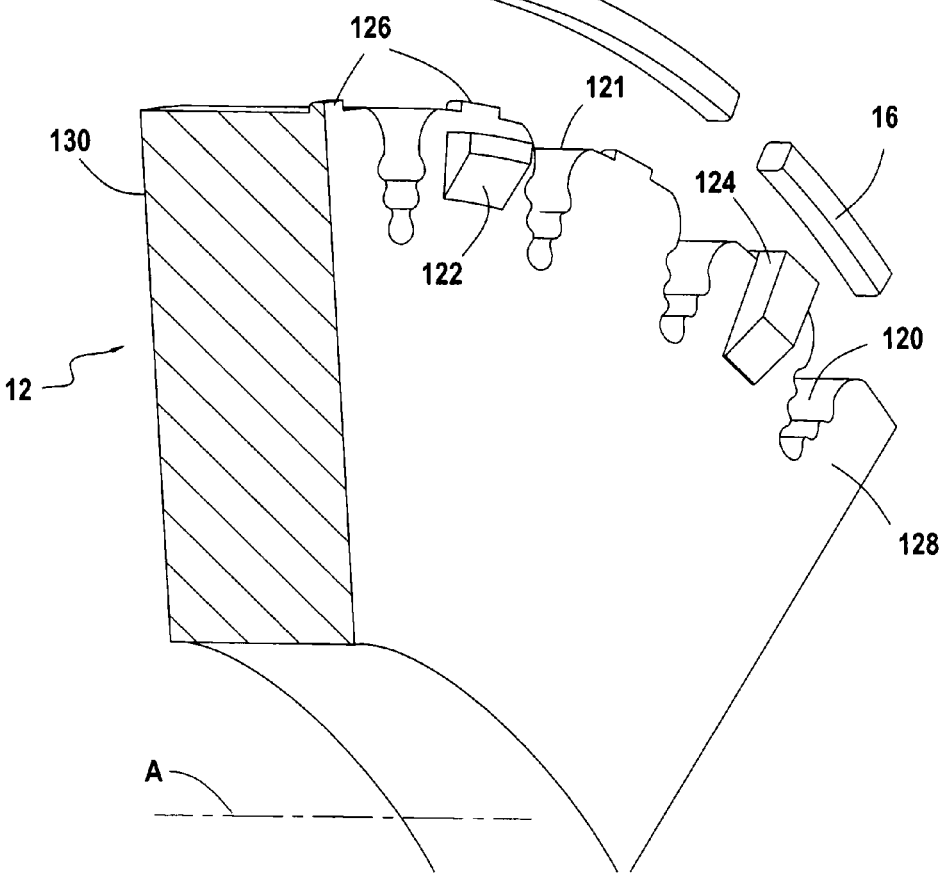

TURBINE WHEEL PROVIDED WITH AN AXIAL RETENTION DEVICE THAT LOCKS BLADES IN RELATION TO A DISK

FIELD OF THE INVENTION

The invention relates in general to bladed wheels in gas turbines, and it relates more particularly to axially retaining said blades relative to the axis of the wheel. The field of application of the invention is, in particular, that of industrial gas turbines and of gas turbine aeroengines.

BACKGROUND OF THE INVENTION

A turbine wheel conventionally comprises a plurality of blades, a disk, and a device for axially retaining the blades. Each blade generally presents an airfoil, a platform, and an attachment member. The blades are mounted at the periphery of the disk, with the attachment member of each blade being engaged in a housing that opens out into the periphery of the disk and that extends axially between two opposite faces of the disk, the housings being separated by teeth. The axial retention device of the blades locks the blades axially relative to the axis of rotation of the disk.

In known turbine wheels, in operation, the blades are sometimes subjected to vibratory movements or vibration. Such vibration is harmful since it can lead to dynamic instabilities of the wheel, which can destroy the wheel, and which can also lead to premature wear of the contact zones between the various elements of the wheel.

OBJECTS AND SUMMARY OF THE INVENTION

An object of the invention is to propose a turbine wheel in which the blades are subjected to substantially less vibration while the wheel is in operation.

This object is achieved by the fact that in a wheel of the above-specified type, at least one of the blades comes into abutment against a first stop member of the disk to block said blade relative to the disk in a first axial direction; the platform of said blade includes a projection projecting axially beyond one of the faces of the disk, said projection including a second stop member; and the axial projection, the second stop member, and said face of the disk form a groove facing towards the axis of the disk, said groove serving to receive the axial retention device in such a manner that the axial retention device, in the assembled position, comes into abutment in the first axial direction against the second stop member, and against said face of the disk in a second axial direction opposite to the first axial direction, whereby said blade is prevented from moving relative to the disk in the second axial direction.

It can thus be understood that the axial retention device locks each blade axially relative to the disk. The blade is prevented from moving axially firstly by the first stop member of the disk and secondly by the axial retention device. The first stop member serves to block the blade axially in the first axial direction, while the axial retention device serves to block the blade axially in the second axial direction. The term "axial" is used to mean a direction extending along the axis of the wheel or the disk. Naturally, in the radial direction, the blade is retained in the housing by co-operation between the shapes of the blade and two teeth of the disk, in known manner.

For example, and preferably, the first axial direction is the direction in which the blades are inserted into the housing in the disk, while the second axial direction is the direction in which the blades can be removed from the disk.

The blade platform possesses an axial projection including a second stop member. The axial projection is designed to extend axially beyond one of the faces of the disk when the blade is mounted on the disk. The second stop member is situated under the platform and projects radially towards the axis of the disk.

When the blade is mounted on the disk, said face of the disk, the axial projection, and the second stop member form a groove that faces towards the axis of the disk. Thus, the bottom face of the platform, opposite from the face carrying the blade airfoil, forms the bottom of the groove, while said face of the disk and the second stop member form the sides of the groove. The groove as defined in this way serves to receive the axial retention device.

The axial retention device is held in the groove in the first axial direction by the second stop member and in the second axial direction by said face of the disk. The axial retention device is also held radially in the centrifugal direction by the bottom of the groove.

When the blade tends to move axially in the second axial direction, the second stop member comes into abutment against the axial retention device, which device in turn comes into abutment against said face of the disk. Thus, the blade is held axially in the second axial direction.

Furthermore, during rotation of the wheel, the centrifugal force applied to the axial retention device tends to press the axial retention device against the bottom of the groove with a certain amount of contact pressure that increases with increasing speed of rotation of the wheel. This presents two advantages. Firstly, being pressed in this way serves to hold the axial retention device against the bottom of the groove. This serves to ensure that the axial retention device remains properly housed within the groove between its sides. Consequently, it is difficult for the axial retention device to escape from the groove.

In addition, this advantageously makes it possible to provide mechanical coupling between the blade and the axial retention device. The flexibility of the axial retention device relative to the stiffness of the blade and the stiffness of the disk serves to damp the azimuth component of the vibration. By damping blade vibration in this way, the amplitude of blade movement is reduced, such that destruction of the blade is advantageously avoided, in particular when the vibration is vibrating at the resonant frequency of the blade.

By means of the invention, firstly the blades are properly held axially on the disk, and secondly blade vibration is damped.

In an advantageous aspect of the invention, at least one bulge is provided between the axial retention device and said blade to establish mechanical contact between the blade and the axial retention device.

The presence of a bulge between the blade and the axial retention device improves the mechanical contact between the blade and the axial retention device, said mechanical contact serving to damp blade vibration. In addition, the bulge may possibly serve to brake any movements of the axial retention device in an azimuth direction, thereby improving the reliability with which the blades are retained axially.

In a variant, the bulge is formed on the axial retention device.

In another variant, the bulge is formed under the axial projection on the bottom of said groove, i.e. against the face that faces the axial retention device.

Advantageously, a recess of shape complementary to the bulge is formed in the element facing the bulge, and is formed in such a manner that the bulge is received in the recess.

It can thus be understood that if the bulge is formed on the axial retention device, the element facing the bulge is the platform and the recess is thus formed under the platform. Conversely, if the bulge is formed under the platform, the element facing the bulge is the axial retention device and the recess is thus formed in the axial retention device. A recess of shape complementary to that of the bulge serves to further improve mechanical contact between the blade and the axial retention device by combining the advantages associated with the presence of a simple bulge and the advantages associated with the presence of facing surfaces without a bulge. The bulge enables contact to be permanent, and since the facing surfaces are very close together because of the recess of shape complementary to the bulge, they provide additional contact during rotation of the wheel as a result of said centrifugal force. In addition, the fact that the bulge is received in a recess also serves to prevent the axial retention device from rotating.

Preferably, the bulge and/or the recess is/are made on or in a portion of the platform that does not support the blade airfoil radially.

By means of this arrangement of the bulge relative to the blade airfoil, it can be understood that the bulge is not situated close to a zone that provides the blade airfoil with radial support, regardless of whether the bulge is located under the platform or on the axial retention device. Thus, the mechanical stresses that result from interactions between the blade and the axial retention device are applied in a zone where the platform is subjected to little mechanical stress. The zones of the platform that are close to the blade airfoil are conventionally significantly stressed by the airfoil.

Advantageously, the disk presents an anti-rotation stop suitable for preventing the axial retention device from moving in an azimuth direction relative to the disk.

An antirotation stop serves to ensure that the axial retention device does not itself start rotating during rotation of the wheel. Furthermore, because of the antirotation stop, the axial retention device remains correctly positioned. The antirotation stop is preferably made in such a manner as to guarantee that the wheel is balanced. Under such circumstances, the antirotation stop balances the mass of the axial retention device that is not necessarily uniformly distributed all around the wheel. Thus, the assembly made up of the axial retention device and the antirotation stop presents a uniform distribution of mass around the wheel and does not unbalance the wheel when it rotates.

Advantageously, the disk also presents at least one safety stop suitable for preventing the axial retention device from making centripetal movements.

A safety stop arranged in this way serves to prevent the axial retention device from moving radially in the groove. This further improves the safety of the axial locking. Preferably, the wheel of the invention has three safety stops that are uniformly distributed at angles of 120° around the disk.

Preferably, the axial retention device is a split ring.

This ring presents the advantage of being a single member serving to retain all of the blades on the disk. In addition, the fact that the ring is split provides it with a certain amount of flexibility relative to radial deformation, and this is advantageous from the point of view of damping azimuth vibration of the blades. Thus, the ring is advantageously resilient, thereby both damping vibration of the blades and also facilitating the operation of assembling the ring on the wheel.

Furthermore, having an axial retention device in the form of a ring makes it possible to achieve mechanical coupling between the ring and a plurality of blades simultaneously. In addition to the practical aspects that the ring presents while the wheel is being assembled, the ring also serves to provide satisfactory damping of the vibration of each blade, thereby avoiding the blades being destroyed.

In addition, in yet another variant, the ring is prestressed so as to make contact with pressure against the platform, thereby enabling the position of the ring to be guaranteed relative to the wheel when the machine is stationary.

Advantageously, the second stop member forms a nib, and preferably, the nib forms a portion of a ring extending over at least a portion of the azimuth length of the axial projection of the platform of the blade.

This preferred embodiment for the second stop member serves to distribute the axial retention forces over each blade platform and thus to avoid any local mechanical stress peaks.

The present invention also provides a turbomachine including a turbine wheel of the invention.

BRIEF DESCRIPTION OF THE DRAWINGS

The invention and its advantages can be better understood on reading the following detailed description of various embodiments given as non-limiting examples. The description refers to the accompanying figures, in which:

FIG. 2A is an exploded view showing a portion of the FIG. 1 turbine wheel.

MORE DETAILED DESCRIPTION

Figure 1:
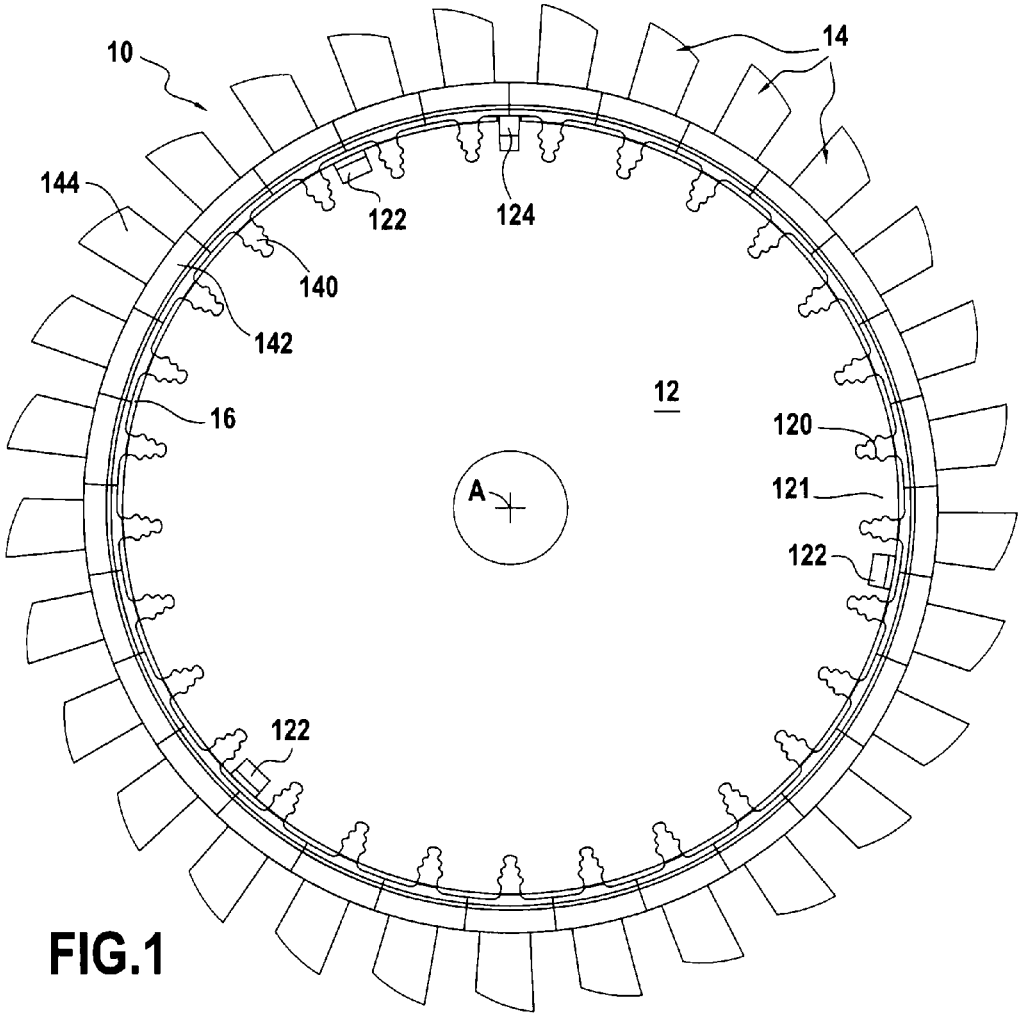
FIG. 1 is an overall view of a turbine wheel of the invention.

FIG. 1 shows an embodiment of a turbine wheel 10 of the invention. The wheel 10 is made up of a disk 12 having an axis A, a plurality of blades 14, and an axial retention device 16. In this example, the axial retention device 16 is a split ring. In the description below of the embodiments of the invention, the term "ring" or "split ring" is used to designate the "axial retention device".

Each of the blades 14 presents an attachment member 140 in the form of a fir-tree shaped root, a platform 142, and a blade airfoil 144. The attachment member 140 is engaged in a housing 120 of the disk 12. The housings 120 extend axially between two opposite faces of the disk, and they are separated by teeth 121. Each blade 14 is held radially via its attachment member 140 by the two teeth 121 adjacent to the attachment member.

The disk 12 is fitted with three safety stops 122 disposed at angles of 120° from one another on the disk. These safety stops 122 hold the ring 16 in its radial position relative to the disk 12 and to the blades 14. The disk 12 is also fitted with an anti-rotation stop 124 to hold the ring 16 in its azimuth position relative to the disk 12 and to the blade 14. The anti-rotation stop 124 is inserted in the split in the ring 16.

FIG. 2A shows an angular portion of the wheel 10 of FIG. 1 in an exploded view. In FIG. 2A, the first stop members 126 and the second stop members 146 can be seen. When the blades are mounted on the disk 12 in a first axial direction X, the first stop members 126 are received in cavities 148 in the blades 14.

The second stop members 146 are located on the bottom face of the platform 142 on an axial projection from the platform 150 that projects from the face 128 of the disk 12. Each second stop member 146 forms a nib such that during assembly of the blade 14 on the disk 12 from the face 130 of the disk 12, the blade attachment member 140 can slide in the housing 120 until the first stop member 126 is received in a cavity 148. In this example, each nib presents additional machining on its azimuth edges so as to avoid interfering with the teeth 121 during assembly. Below, the term "nib" is used for the "second stop member".

In this example, each nib 146 forms a portion of a ring, such that when the blades 14 are assembled on the disk 12, the nibs 146 together form a discontinuous ring.

Figure 2B:
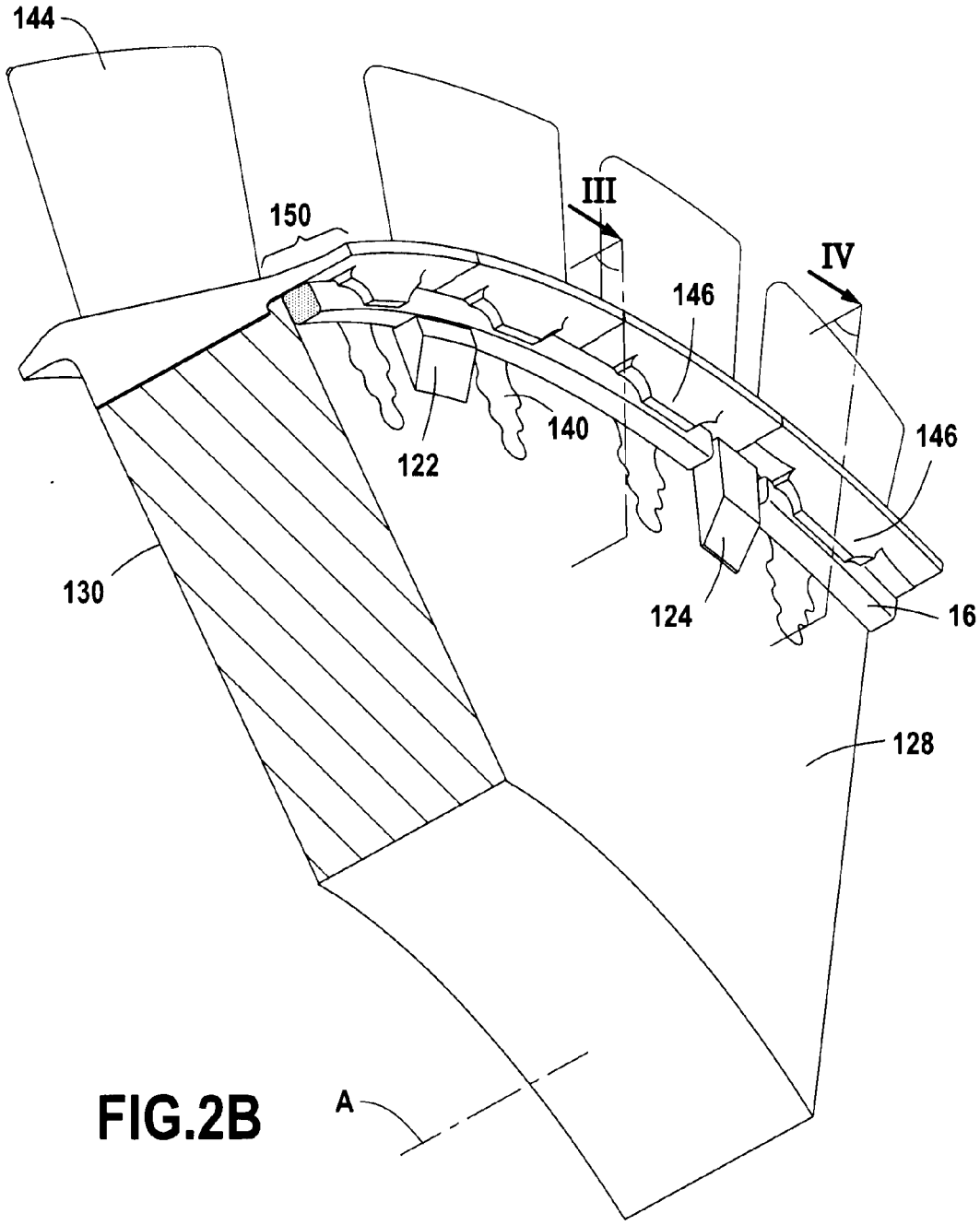
FIG. 2B shows the same portion of the turbine once assembled.

FIG. 2B shows a portion of the wheel described with reference to FIG. 2A once it has been assembled. The bottom face of the axial projection 150, the face 128 of the disk, and the face of the nib 146 that faces the face 128 of the disk 12 (or that faces the blade attachment member 140) together form a groove facing towards the axis A of the disk. The ring 16 is housed in this groove.

Figure 3:
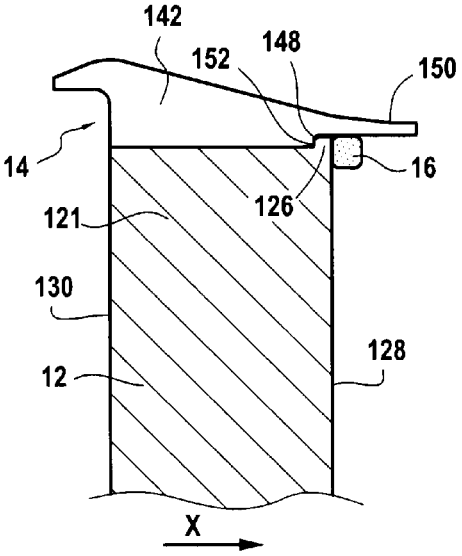
FIG. 3 is a section view on plane III of FIG. 2B.

Assembly of the axial retention device is described below with reference to FIGS. 3 and 4. FIG. 3 is an axial section view of the example shown in FIG. 2B on section plane III. The blade 14 of FIG. 3 is engaged in its housing 120 in the first axial direction X until one of the contact faces 152 of the platform 142 comes into abutment against the first stop member 126 of the disk 12. The blade is then blocked in the first axial direction X.

Figure 4:
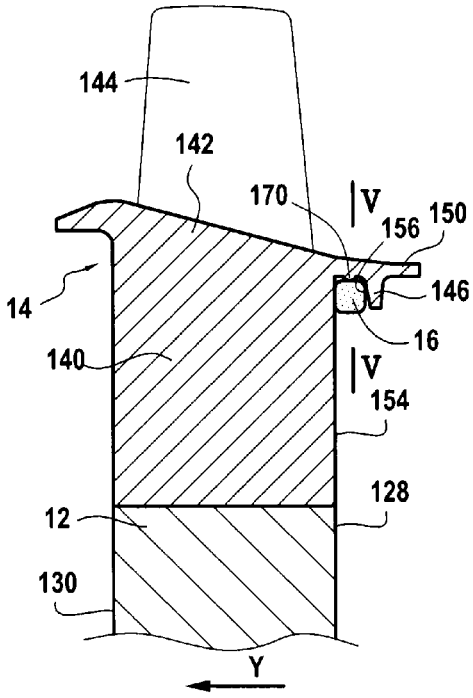
FIG. 4 is a section view on plane IV of FIG. 2B.

Thereafter, as can be seen in FIG. 4 (section on plane IV of FIG. 2B), the ring 16 is located under the projection 150, between the face 154 of the blade attachment member 140 that extends the face 128 of the disk 12, and the face 156 of the nib 146 that faces the face 154. The blade is thus held axially in the second axial direction Y opposite to the first axial direction X by the nib 146 that comes into abutment against the ring 16, which itself bears against the face 128 of the disk 12 and of the first stop member 126 (cf. FIG. 3). The blade is thus held in both opposite axial directions X and Y by the interaction between the axial retention device 16, firstly with the first stop member 126 and secondly with the second stop member 146.

Still with reference to FIG. 4, it should be observed that in an advantageous aspect of the invention, the platform 142 is provided with at least one bulge 170. The bulge 170 is on the bottom face of the platform 142, and more particularly on the bottom face of its axial projection 150. More precisely, with reference to the groove in which the ring 16 is housed, the bulge 170 is formed on the bottom of said groove.

In addition, in the radial direction, the bulge 170 is not located in register with the blade airfoil 144, i.e. the blade airfoil 144 and the bulge 170 are offset in an axial direction. The blade airfoil 144 is supported radially by the portion of the platform that is supported by the blade attachment member 140 and it does not encroach on the axial projection 150. In other words, the bulge 170 is not situated on a portion of the platform 142 that radially supports the blade airfoil 144.

FIGS. 5A to 5E show several variant ring/platform interfaces on section plane V of FIG. 4.

Figure 5A:
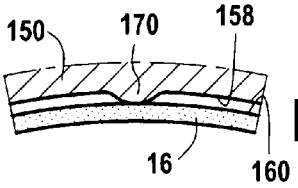
FIGS. 5A to 5E show different embodiments of the axial retention ring in section plane V of FIG. 4.

FIG. 5A corresponds to the embodiment shown in FIG. 4. In the same manner as in FIG. 4, a single bulge 170 is shown in FIG. 5A. The ring/platform interface is provided by contact between the bulge 170 and the ring 16. The surface 160 of the ring 16 facing the bottom of the groove 158 is substantially smooth.

Figure 5C:
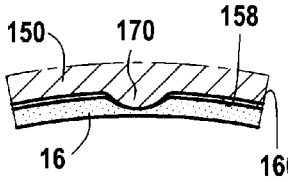
Figure 5B:
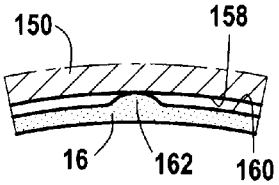

FIG. 5B shows an alternative embodiment in which, unlike the embodiment described above, the ring 16 presents a plurality of bulges 162 positioned on the circumference of the ring (only one bulge is shown), while the bottom of the groove 158 is smooth.

Figure 5D:
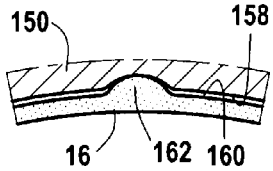

FIGS. 5C and 5D, respectively similar to FIGS. 5A and 5B, show bulges 170 and 162 that are located in respective recesses of complementary shape formed in register with said bulges. In the configuration of FIG. 5C, the bulges 170 are under the platforms 142 and the ring 16 presents recesses of complementary shape. In the configuration of FIG. 5D, the bulges 162 are formed on the circumference of the ring 16 and recesses are formed in the blade platforms 142. Either way, the ring 16 is then advantageously held in the azimuth direction by interaction between the bulges and the recesses of complementary shape.

Figure 5E:
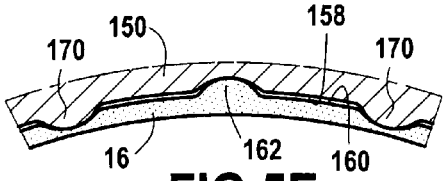

FIG. 5E shows a variant that combines the presence simultaneously of bulges and recesses both on the ring 16 and on the projection 150.

Figure 6:
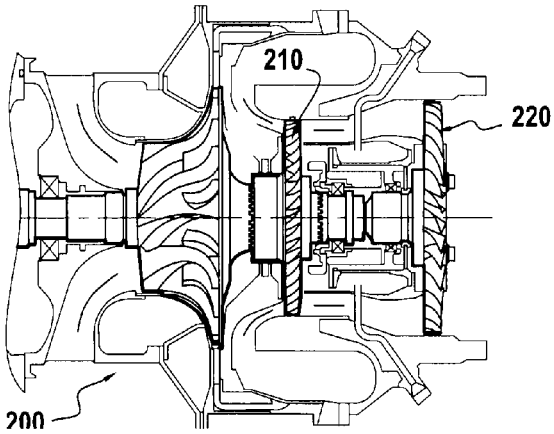
FIG. 6 shows a turbine fitted with a turbine wheel of the invention.

FIG. 6 shows a turbomachine 200 fitted with a turbine wheel of the invention. In this example, the turbine wheel of the gas generator 210 and the free turbine wheel 220 are both in accordance with the present invention.

The invention claimed is:

1. A turbine wheel comprising:

a plurality of blades, each blade presenting an airfoil, a platform, and an attachment member;

a disk having the blades mounted at a periphery thereof, the attachment member of each blade being engaged in a housing that opens into the periphery of the disk and that extends axially between two opposite faces of the disk, the housings being separated by teeth;

an axial retention device for retaining the blades by locking the blades axially relative to the disk;

wherein at least one of the blades comes into abutment against a first stop member of the disk to block the blade relative to the disk in a first axial direction, the first stop member extending radially outward from an outermost radial surface of one of the teeth of the disk at a downstream portion thereof, the first stop member being received in a cavity of the blade and abutting a contact face of the platform of the blade, the platform of the blade includes a projection projecting axially beyond one of the faces of the disk, the projection including a second stop member, and the axial projection, the second stop member, and the face of the disk form a groove facing towards the axis of the disk, the groove serving to receive the axial retention device such that the axial retention device, in the assembled position, comes into abutment in the first axial direction against the second stop member, and against the face of the disk in a second axial direction opposite to the first axial direction, whereby the blade is prevented from moving relative to the disk in the second axial direction.

2. A turbine wheel according to claim 1, wherein at least one bulge is provided between the axial retention device and the blade to establish mechanical contact between the blade and the axial retention device.

3. A turbine wheel according to claim 2, wherein the at least one bulge is formed on the axial retention device.

4. A turbine wheel according to claim 2, wherein a recess of shape complementary to the at least one bulge is formed in the element facing the bulge, and is formed such that the at least one bulge is received in the recess.

5. A turbine wheel according to claim 4, wherein at least one of the at least one bulge or the recess is made on or in a portion of the platform that does not support the blade airfoil radially.

6. A turbine wheel according to claim 1, wherein the disk presents an anti-rotation stop configured to prevent the axial retention device from moving in an azimuth direction relative to the disk.

7. A turbine wheel according to claim 1, wherein the disk further presents at least one safety stop configured to prevent the axial retention device from making centripetal movements.

8. A turbine wheel according to claim 1, wherein the axial retention device is a split ring.

9. A turbine wheel according to claim 1, wherein the second stop member forms a nib.

10. A turbine wheel according to claim 9, wherein the nib forms a portion of a ring extending over at least a portion of the azimuth length of the axial projection of the platform of the blade.

11. A turbomachine including at least one turbine wheel according to claim 1.

12. A turbine wheel comprising:

a plurality of blades, each blade presenting an airfoil, a platform, and an attachment member;

a disk having the blades mounted at a periphery thereof, the attachment member of each blade being engaged in a housing that opens into the periphery of the disk and that extends axially between two opposite faces of the disk, the housings being separated by teeth;

an axial retention device for retaining the blades by locking the blades axially relative to the disk;

wherein at least one of the blades comes into abutment against a first stop member of the disk to block the blade relative to the disk in a first axial direction, the platform of the blade includes a projection projecting axially beyond one of the faces of the disk, the projection including a second stop member, the axial projection, the second stop member, and the face of the disk form a groove facing towards the axis of the disk, the groove serving to receive the axial retention device such that the axial retention device, in the assembled position, comes into abutment in the first axial direction against the second stop member, and against the face of the disk in a second axial direction opposite to the first axial direction, whereby the blade is prevented from moving relative to the disk in the second axial direction, at least one bulge is provided between the axial retention device and the blade to establish mechanical contact between the blade and the axial retention device, and the at least one bulge is formed under the axial projection on the bottom of the groove.

13. A turbine wheel comprising:

a plurality of blades, each blade presenting an airfoil, a platform, and an attachment member;

a disk having the blades mounted at a periphery thereof, the attachment member of each blade being engaged in a housing that opens into the periphery of the disk and that extends axially between two opposite faces of the disk, the housings being separated by teeth;

an axial retention device for retaining the blades by locking the blades axially relative to the disk;

wherein at least one of the blades comes into abutment against a first stop member of the disk to block the blade relative to the disk in a first axial direction, the platform of the blade includes a projection projecting axially beyond one of the faces of the disk, the projection including a second stop member, the axial projection, the second stop member, and the face of the disk form a groove facing towards the axis of the disk, the groove serving to receive the axial retention device such that the axial retention device, in the assembled position, comes into abutment in the first axial direction against the second stop member, and against the face of the disk in a second axial direction opposite to the first axial direction, whereby the blade is prevented from moving relative to the disk in the second axial direction, at least one bulge is provided between the axial retention device and the blade to establish mechanical contact between the blade and the axial retention device, and the at least one bulge is made on a portion of the platform that does not support the blade airfoil radially.

* * * * *